United States Patent [19]

Ozaki

[11] 4,170,950

[45] Oct. 16, 1979

[54] SEWING MACHINE WITH PATTERN SELECTION INDICATOR

[75] Inventor: Yoshiaki Ozaki, Hachioji, Japan

[73] Assignee: Janome Sewing Machine Co., Ltd., Tokyo, Japan

[21] Appl. No.: 934,316

[22] Filed: Aug. 16, 1978

[30] Foreign Application Priority Data

Aug. 19, 1977 [JP] Japan ..... 52-110128[U]

[51] Int. Cl.[2] ..... D05B 3/02; D05B 79/00

[52] U.S. Cl. ..... 112/158 F; 112/158 A; 362/29

[58] Field of Search ..... 112/158 F, 158 A, 158 E, 112/121.11, 121.12; 362/29, 31

[56] References Cited

U.S. PATENT DOCUMENTS

| | | | |
|---|---|---|---|
| 3,070,050 | 12/1962 | Holl et al. | 112/158 F |
| 4,005,664 | 2/1977 | Garron | 112/158 E |

FOREIGN PATENT DOCUMENTS

| | | | |
|---|---|---|---|
| 232444 | 1/1961 | Australia | 112/158 F |
| 45-4822 | 2/1970 | Japan | 112/158 A |

*Primary Examiner*—Werner H. Schroeder
*Assistant Examiner*—Andrew M. Falik
*Attorney, Agent, or Firm*—Michael J. Striker

[57] ABSTRACT

A sewing machine has a machine housing. A group of pattern cams is arranged in the housing. A cam follower is movable along the group of pattern cams for selecting a desired one of these cams. A pattern indicating panel on the housing shows a row of pattern illustrations corresponding to the patterns which can be produced by the pattern cams. A manual arrangement moves the cam follower along the group of cams. An electrically illuminable pattern pointer is connected to the arrangement and movable along the row of pattern illustrations, in timed relation with the movement of the cam follower to point out a pattern illustration corresponding to a selected pattern cam. An electric circuit, including a power source and a switch electrically connects the power source with the pattern pointer to illuminate the latter. A switch operating arrangement is operated in timed relation with the movement of the cam follower to connect the pattern pointer to the power source so that the pointer may become illuminated and thus point out the selected pattern.

7 Claims, 4 Drawing Figures

SEWING MACHINE WITH PATTERN SELECTION INDICATOR

BACKGROUND OF THE INVENTION

The invention relates to a sewing machine.

More particularly the invention relates to a sewing machine with a device for indicating a selected stitch pattern with an electrically lighted pointer so as to positively identify the selected pattern.

In conventional sewing machines having built-in cams for producing different stitch patterns, the pattern selection is carried out by manually shifting a pointer along a row of pattern indications shown on a back-lighted panel. However, if the pointer is obscure or if the lamp lighting the panel is dark, the selected pattern can not be clearly identified and therefore the machine operator is likely to select a wrong pattern. Accordingly, improvements in this respect are desirable.

SUMMARY OF THE INVENTION

It is an object of the invention to overcome the disadvantages of the prior art.

A more particular object of the invention is to identify a selected pattern by employing an electrically lighted pointer which is moved along a row of pattern indications and which is lighted each time it comes to one of the pattern indications.

Another object is to provide such a pattern selection indicating device which is simple in structure and easy to operate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
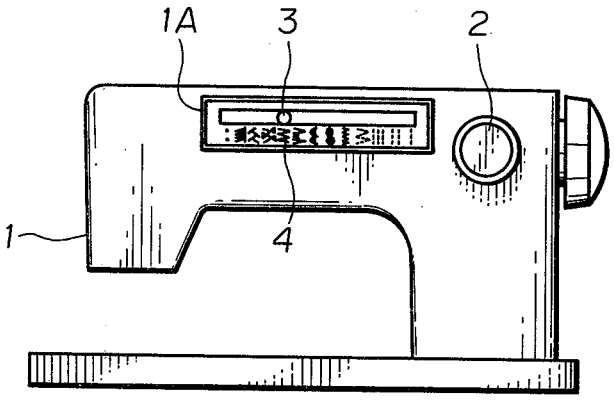
FIG. 1 is a side elevation of a sewing machine provided with a pattern selection indicating device according to the invention.

FIG. 1 shows a sewing machine having a machine housing 1 provided, at its front face, with a pattern indicating section 1A in which a lighting indicator 3 and a panel 4 are arranged. The panel 4 is, as shown, printed or otherwise provided with various selectable stitch patterns and the lighting indicator 3, which may, e.g., be a luminous diode, is moved to the right and to the left along the row of stitch patterns on panel 4 via a timing belt 18 (FIG. 3) which is operated by a rotatable pattern selecting dial or knob 2 mounted on the front face of the machine housing 1.

Figure 2:
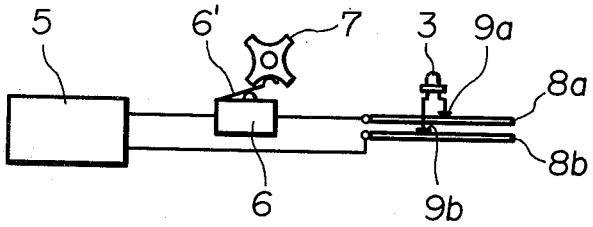
FIG. 2 is a block diagram of an electrical circuit of the present device.

FIG. 2 shows a circuit diagram of the device according to the invention. Reference numeral 5 identifies a power source for the luminous (i.e., light-emitting) diode 3. Numeral 6 identifies a normally open switch for controlling the supply of electrical energy to the diode 3. A switch cam 7 is connected to the pattern selecting dial 2 to be turned upon rotation of the same and is formed with recesses and projections as shown. The normally open switch 6 has an operating element 6' (i.e., a trip) which is depressed by engagement with the respective projections of the switch cam 7 to close the internal circuit of the switch 6. Numerals **8*a*, 8*b* identify electrical conductors which are in circuit with the source 5 to supply electric current to the luminous diode 3, and numerals 9*a*, 9*b* identify contacts of the diode 3**.

Figure 3:
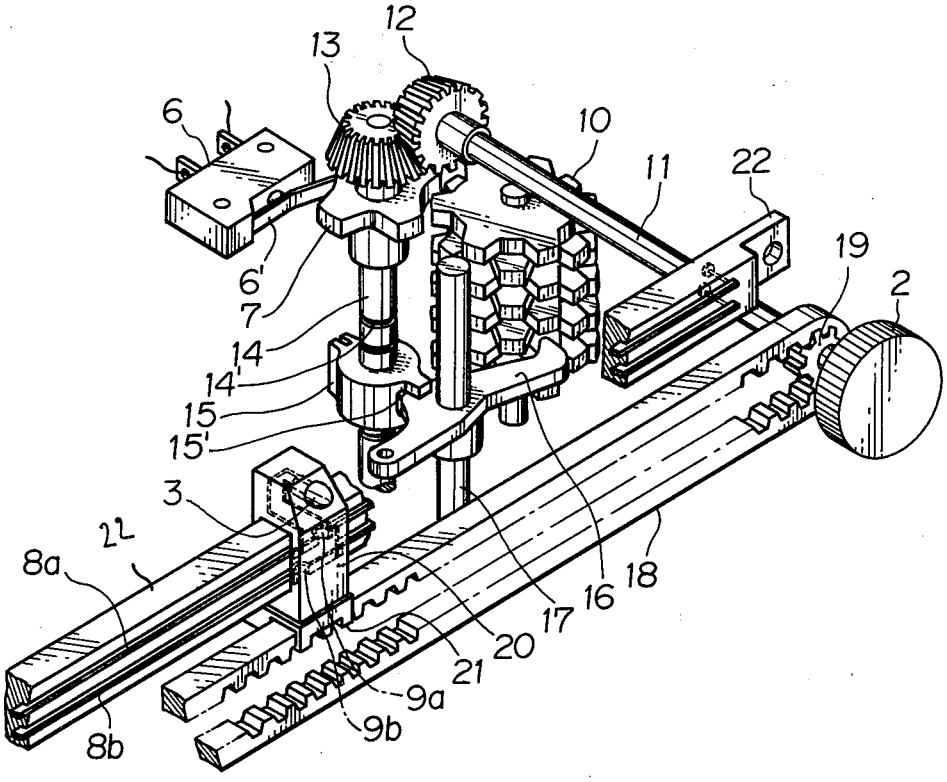
FIG. 3 is a perspective view showing the operating mechanism of the present device.

The operating mechanism of the device according to the invention is shown in FIG. 3. As shown, a group of pattern cams 10 are mounted on a shaft for rotation therewith in the machine housing 1. The switch cam 7 is mounted on a shaft 14 for rotation therewith. A bevel gear 13 is secured to the top of the shaft 14 and is in mesh with another bevel gear 12 which is secured to the inner end of a transverse shaft 11 mounted so as to extend within and across the machine housing 1. The pattern selecting dial 2 is secured to the outer end of the shaft 11 which for this purpose projects out of the machine housing 1. The preferably vertical shaft 14 is formed with a spiral groove 14' which is engaged by a nut 15 with a forked part 15'. The nut 15 is held against rotation but can move axially of shaft 14 when the same is rotated. A cam follower 16 is turnably mounted on a fixed, also preferably vertical shaft 17 and is adapted to engage one of the pattern cams under the influence of a biasing spring (not shown). The cam follower 16 can be disengaged from the cam by a follower disengaging mechanism (not shown) which can be operated by manual rotation of the pattern selecting dial 2 at the time a pattern cam selection is made, and which can be operated to allow the follower 16 to engage a selected cam under the influence of the spring when the cam selecting operation has been completed and subsequently the sewing machine is operated.

The central projection of the cam follower 16 is inserted into the bifurcation of the part 15' of the nut 15. Therefore, depending upon the rotation of the pattern selecting dial 2 in the clockwise or counter-clockwise direction, the cam follower 16—which may either be slidable axially along the shaft 17 or which may be axially fixed on the shaft if the entire shaft 17 is mounted to be axially slidable—is shifted in the upward or in the downward direction along the cam group 10 by the nut 15 which is in engagement with the spiral groove 14' of the vertical shaft 14. The lobes or projections on cam 7 are so positioned that whenever the cam follower 16 is located opposite one of the cams 10, one of the projections of the cam 7 closes the switch 6 to supply electric current from the power source 5 (FIG. 2) to the luminous diode 3 to light the same.

Further in reference to FIG. 3, an endless timing belt 18 is at one end of its run in engagement with a gear 19 secured to the transverse shaft 11 as shown, and at the other end of its run it is in engagement with another gear (not shown) which is turnably mounted on the machine housing 1. The luminous diode 3 is mounted on a holder 20 which in turn is slideably guided in an elongated track 22 of electrically insulating material; the guide track 22 is arranged on the machine housing in parallel with the timing belt 18. The holder 20 is connected to the timing belt as shown, by a connecting element 21, so as to move with the belt 18 when shaft 11 is turned. The elongated electrical conductors 8a, 8b are also provided on the guide 22, each spaced from the other and extending in parallel with each other all along the guide track 22. The luminous diode 3 is provided with the contacts 9a, 9b which are in slideable engagement with the conductors 8a, 8b respectively, so as to form therewith a circuit to supply electric current to the luminous diode 3.

When, prior to a pattern stitching operation, the pattern selecting dial 2 of the embodiment in FIGS. 1–3 is manually rotated to make a pattern cam selection, the cam follower 16 is first disengaged from the pattern cam with which it was previously in contact. During further rotation of the dial 2 the switch 6 is alternately opened and closed by the switch cam 7 as the cam follower 15 is shifted axially along the cam group 10. Simultaneously the luminous diode 3 is alternately energized and de-energized as it slides along the stitch patterns indicated on the panel 4. Specifically, the luminous diode 3 is lighted each time when it comes to one of the pattern indications, and is extinguished each time when it moves beyond the respective pattern indication. If a desired pattern cam 10 has been selected, the luminous diode 3 comes to rest opposite the corresponding stitch pattern indication on the panel 4 and now continues to be lighted since the dial 2 is no longer being turned. When thereafter the sewing machine is driven, the cam follower 16 automatically engages the cam which was selected as described above and the cam follower is swung by this cam and transmits this swinging movement in accordance with the configuration of the cam to the needle bar. This forms no part of the invention.

Figure 4:
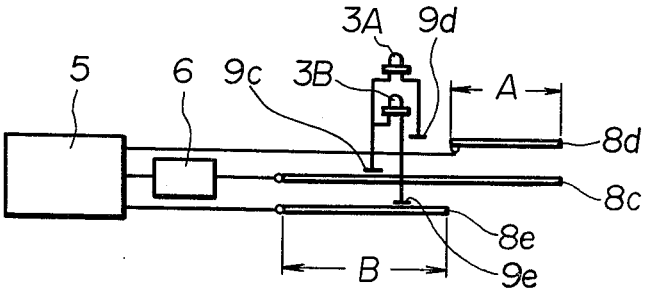
FIG. 4 is a block diagram of an electrical circuit according to another embodiment of the invention.

FIG. 4 shows another embodiment of the electrical circuit, in which three conductors 8c, 8d, 8e are arranged as shown with respect to the power source 5 and the switch 6. The conductor 8c extends all along the length of the row of stitch pattern indications on the panel 4 (not shown in FIG. 4). The conductor 8d extends along an optionally divided region A of the row of stitch pattern indications, and the conductor 8e extends along the remaining region B of the row of stitch pattern indications. In this embodiment, two luminous diodes 3A, 3B are provided with three contacts 9c, 9d, 9e. The contact 9c is common to both of the diodes and slideably engages the conductor 8c which is connected to the power source 5 and to the switch 6. The contact 9d is connected to the diode 3A and is designed to slideably engage the conductor 8d which is connected to the power source 5 and extends along the region A of the pattern indications, and the contact 9e is connected to the diode 3B and is designed to slideably engage the conductor 8e which is connected to the power source 5 and extends along the region B of the pattern indications. Thus, while the contact 9e engages the conductor 8e, the contact 9d is disengaged from the conductor 8d, and while the contact 9d engages the conductor 8d, the contact 9e is disengaged from the conductor 8e. In this embodiment, the two luminous diodes 3A, 3B are designed to light with different colors so as to indicate two different groups of pattern indications on the panel 4, for example, a group of utility pattern indications and another group of ornamental pattern indications.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sewing machine, comprising a machine housing; a group of pattern cams arranged in the machine housing; cam follower means movable along the group of pattern cams; means for moving the cam follower means along the group of pattern cams for selecting a desired one of said cams; pattern indicating means on the machine housing and showing a row of pattern illustrations corresponding to the patterns which can be produced by the pattern cams; manually operated means for moving the cam follower moving means along the group of cams; electrically illuminable pattern pointer means operatively connected to the manually operated means and movable along the row of pattern illustrations, in timed relation with the movement of the cam follower means to point out a pattern illustration corresponding to a selected pattern cam; electric circuit means, including a power source and a switch, for electrically connecting the power source with the pattern pointer means to illuminate the pointer means; and switch operating means operatively connected to the manually operated means and operated in timed relation with the movement of the cam follower means to connect the pattern pointer means to the power source so that the pointer means may become illuminated and thus point out the selected pattern.

2. A sewing machine as defined in claim 1, wherein said pointer means comprises a luminous diode.

3. A sewing machine as defined in claim 1, wherein said switch operating means comprises a switch cam which is rotated by operation of the manually operated means to operate the switch and thereby connect the pointer means to the power source each time the moving cam follower means arrives at a position in which it is engageable with one of the pattern cams of said group.

4. A sewing machine as defined in claim 1, wherein the electric circuit means includes a pair of elongated conductors connected to the power source and to the switch and in sliding engagement with the pointer means.

5. A sewing machine as defined in claim 4; further comprising an elongated guide on which the pointer means is slidingly movable along the row of pattern illustrations, said conductors being mounted on and extending lengthwise of said guide.

6. A sewing machine as defined in claim 1, wherein the pattern pointer means comprises two luminous diodes each having a different color; said electric circuit means including three conductors so arranged that the respective diodes point to two divided regions of the row of pattern illustrations with two different colors of light.

7. A sewing machine as defined in claim 6, wherein one of said conductors extends along a first longitudinal portion of the row of pattern illustrations and another of said conductors extends along a different second longitudinal portion of the same row; said diodes including one contact common to them and in sliding engagement with a third one of said conductors, one contact on one of said diodes and slidably engageable only with said one conductor when said one diode is located opposite said first longitudinal portion; and another contact on the other of said diodes and slidably engageable only with said other conductor when said diode is located opposite said second longitudinal portion.

* * * * *